US005816844A

United States Patent [19]

Perera

[11] Patent Number: 5,816,844

[45] Date of Patent: Oct. 6, 1998

[54] INSULATION DISPLACING ELECTRICAL CONNECTOR

[75] Inventor: Athula Perera, Carlingford, Australia

[73] Assignee: Krone Aktiengesellschaft, Berlin-Zehlendorf, Germany

[21] Appl. No.: 701,739

[22] Filed: Aug. 22, 1996

[30] Foreign Application Priority Data

Aug. 23, 1995 [AU] Australia ..... PN4994

[51] Int. Cl.[6] ..... H01R 4/26

[52] U.S. Cl. ..... 439/416; 439/431; 439/412; 439/814; 411/82; 411/930; 411/587

[58] Field of Search ..... 439/416, 415, 439/411, 412, 413, 431, 433, 434, 435, 798, 797, 810, 814; 411/82, 258, 930, 386, 387

[56] References Cited

U.S. PATENT DOCUMENTS

| | | | |
|---|---|---|---|
| 1,247,356 | 11/1917 | Wooden | 439/416 |
| 1,963,542 | 6/1934 | Bergstrom | 411/386 |
| 3,816,817 | 6/1974 | Ball et al. | 439/416 |
| 4,055,051 | 10/1977 | Finney | 411/82 |
| 4,103,984 | 8/1978 | Mixon, Jr. | 439/415 |
| 5,249,899 | 10/1993 | Wilson | 411/82 |

FOREIGN PATENT DOCUMENTS

| | | | |
|---|---|---|---|
| 471769 | 11/1914 | France | 439/411 |
| 2021510 | 7/1970 | France . | |
| 1259993 | 2/1968 | Germany . | |
| 1928341 | 12/1970 | Germany . | |
| 552896 | 8/1974 | Switzerland . | |
| 1172119 | 11/1969 | United Kingdom . | |
| 1198797 | 7/1970 | United Kingdom . | |

*Primary Examiner*—Neil Abrams
*Assistant Examiner*—Tho D. Ta
*Attorney, Agent, or Firm*—McGlew and Tuttle

[57] ABSTRACT

An electrical connector for establishing an electrical connection to an electrical conductor. The connector includes a connector body with a cylindrical hull or recess for receiving the electrical conductor with an insulating layer. A contact screw is positioned in the connector body and the contact screw includes an end portion for displacing or piercing the insulating layer of the insulated conductor.

17 Claims, 7 Drawing Sheets

FIG 10
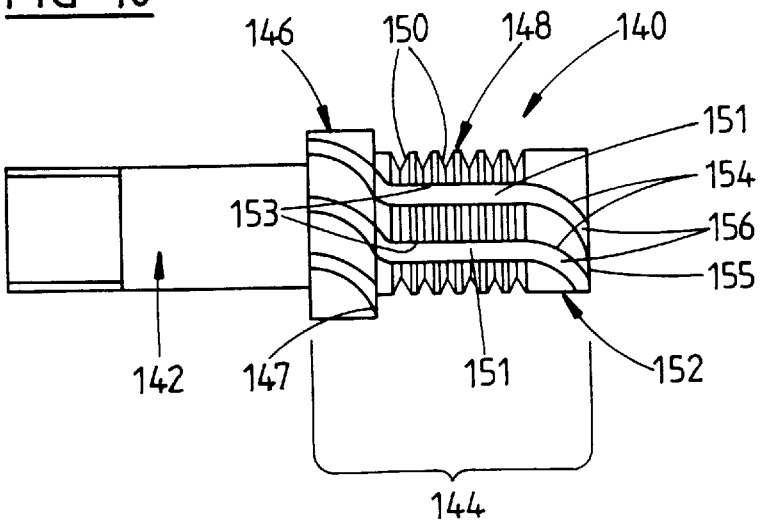
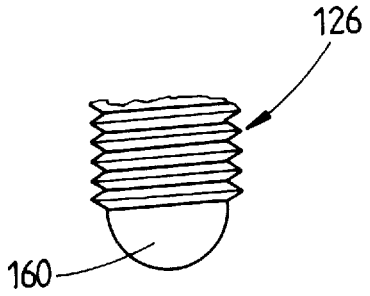
FIG 11

INSULATION DISPLACING ELECTRICAL CONNECTOR

FIELD OF THE INVENTION

This invention relates to an electrical connector for making an electrical connection to an insulated electrical conductor.

BACKGROUND OF THE INVENTION

In power distribution systems which utilize insulated cables it has traditionally been necessary to strip the insulation from an end of a cable in order to make electrical connection thereto. For example, it may be desired to terminate an insulated cable at an electrical connector for connection to a circuit breaker or the like. Traditionally, terminating power cables such as those used to carry heavy current or high voltage has not been difficult because such cables have been supported by overhead by towers or poles and thus have not needed to be insulated. Recently, however, there has been an increase in the placement of power cables underground, for instance, thus requiring that the cables be insulated such as by way of an outer sheath of plastic material. This outer sheath can cause difficulties in terminating such cables because, in order to make good electrical contact with the conductor(s) of the cable it has previously been necessary to have access to at least some axial length of the conductors at the cable end. This requires that a length of insulation be removed from the cable to facilitate making electrical connection to the conductor(s) underneath. Stripping the insulation layer can be an arduous and time consuming task for power cables, which may be several millimeters to centimeters in diameter with an insulative layer which is a few millimeters thick.

GB 1198797 describes an electrical connector for making an electrical connection to an electrical conductor sheathed by an insulative covering, comprising:

a conductor receptacle having a recess therein for receiving an insulated portion of an electrical conductor; and electrical contact means supported by the receptacle and moveable transversely thereto the conductor when received in the recess, the contact means having an end portion adapted to displace or pierce an insulative covering of said portion of the insulated conductor and make electrical connection to said conductor upon such transverse movement.

In the construction of GB 1198797, the contact means is a rotatable screw component threadedly received in the conductor receptacle. The recess for receiving the electrical conductor is provided with a conical recess opposite the location where the contact means is provided so that when the contact means is advanced to pierce the insulative covering of the conductor, part of the cable is pressed into the conical recess to facilitate holding. This arrangement is however not suitable for heavier cables where considerable force would be required to effect the necessary deformation of the cable into the recess. The cable may be engaged by opposed movable contact means, an opposed fixed protuberance or the like, such as described in UK 1172119, DE 1259993, FR 2021510, U.S. Pat. No. 3,816,817 and DE 1928341.

In GB 1239738, the cable is engaged at one side by electrical contact means which penetrates the cable sheath, and at an opposed side of the sheath, wedges are provided on another part of the connector to make contact with the conductors of the cable. The wedges are formed of insulative material or are otherwise insulated so as not to provide a current conducting path. In CH 552896, there are transverse parts opposite the contact member, these being mounted on a movable element. Generally, it has been found that the provision of such transverse engaging parts opposite the contact member facilitates holding but, particularly with heavy cables, adequate holding or electrical coupling may still not be achieved with these constructions, particularly in view of the provision of the transverse engaging parts as separate elements, which, whether due to insulative isolation or increased contact resistance, do not provide fully effective operation, or effective resistance to relaxation of cable holding pressure over time.

FIG. 1 illustrates a conventional way of making electrical connection to an insulated cable 4 which comprises a core 6 consisting of an electrical conductor which may be formed from a plurality of strands, which is sheathed by an insulative layer 8. The conventional electrical connector 2 comprises a connector body 10 which has a cylindrical hole 12 therein for receiving the conductor core 6. In order to make an electrical connection between the conductor 6 of the cable 4 and the electrical connector 2, it is first necessary to remove a portion of the insulative sheath 8 from the end of the cable. Removing the insulative sheath 8 exposes a portion of the conductor core 6, which portion is then inserted into the cylindrical hole 12 formed in the connector body 10. The cylindrical hole 12 is dimensioned in cross section so as to fit with the conductor core 6 when inserted therein. Additionally, the cylindrical hole 12 is provided with an electrically conductive lining which covers at least a portion of the interior surface of the hole. Thus, when the conductor core 6 is fitted into the cylindrical hole 12, with a tight fit occurring between the outer conductive surface of the core 6 and the inner surface of hole 12 containing an electrically conductive lining, an electrical connection is formed between the conductive lining of the hole and the conductor core 6 of the electrical cable 4. In order to hold the end portion of the cable to the electrical connector 2, a clamping bolt or screw 14 is provided which passes through a wall of the connector body 10 such that an end thereof can engage the conductor core 6 when inserted in cylindrical hole 12. By rotating the clamping bolt 14 so as to engage the conductor core 6, the end portion of the cable 4 is clamped within the cylindrical hole 12, which both physically holds the cable 4 and connector 2 against separation and presses the conductor core 6 into better electrical contact with the conductive lining in the cylindrical hole 12 of the electrical connector.

Bearing in mind that in the case of a high current or high voltage power conductor the cable 4 may be several millimeters to centimeters in diameter with an insulative layer of a few millimeters in thickness, the removal of a portion of the insulative layer can be a time consuming and arduous task, requiring a hand cutting tool, for example.

SUMMARY AND OBJECTS OF THE INVENTION

In one aspect, the invention provides an electrical connector for making electrical connection to an electrical conductor sheathed by an insulative covering, comprising:

a conductor receptacle having a recess therein for receiving an insulated portion of an electrical conductor; and electrical contact means supported by the receptacle and moveable transversely thereto the conductor when received in the recess, the contact means having an end portion adapted to displace or pierce an insulative covering of the portion of the insulated conductor and make electrical connection to the conductor upon such transverse movement, the recess having knife edged protrusions to facilitate the insulation piercing and electrical connection on a side of the electrical conductor opposite to the contact means, said conductor receptacle being electrically conductive and said knife edged protrusions being formed integrally with the receptacle, the electrical contact means being electrically connected to the receptacle.

In one form of the invention, the conductor receptacle comprises a housing having a generally cylindrical or contoured hole or passage therein which constitutes said recess. The electrical contact means can then extend through a wall of the housing from the outside thereof such that the end portion, in use, protrudes into the recess. In this way, the insulated conductor portion can be inserted in the recess and the contact means adjusted to protrude into the recess to thereby displace or pierce the insulation adjacent thereto, make electrical connection to the underlying electrical conductor, and at the same time clamp the insulated conductor portion in the recess. Advantageously, the recess is dimensioned in cross-section to allow an insulated conductor portion to be inserted therein with only a small clearance between the exterior of the insulative layer and the interior surface of the recess itself.

In one form of the invention, the contact means is provided with an external screw thread for engaging an internally threaded passage in the conductor receptacle, wherein rotation of the contact means effects relative movement as between the contact means and receptacle so as to cause the contact means end portion to protrude into the recess to make said electrical connection with an insulated conductor when inserted therein. Alternatively, the contact means may undergo movement relative to the receptacle under action of any convenient driving means and held in its electrically connecting orientation by way of a spring bias or the elasticity of the device as a whole. In another form of the invention the screw threaded contact means engages a spring loaded block which is spring biased towards the recess to help maintain electrical contact subsequent to insulation piercing. In another form of the invention, the relative movement between the threaded contact means and the receptacle is effective to displace, cut and pierce the insulation, both at the end portion of the contact means and the knife edged protrusions provided in the recess of the contact receptacle.

The end portion of the contact means may be provided with an insulation cutting surface to aid the end portion in piercing or displacing the insulative layer. For example, the contact means can be in the form of a screw threaded bolt or the like, having a generally rounded end with a radially and axially extending cutting edge.

Additionally, to aid in making and keeping electrical connection between the contact means and electrical conductor, a jointing compound can be provided on the end portion of the contact means. For example, the contact means end portion can be constructed with one or more cavities which are filled with jointing compound before electrical connection is made to an electrical conductor. A cavity filled with jointing compound can also be provided where the contact means engages the conductor receptacle to enable a reliable electrical contact to be maintained therebetween. The outer edge of this cavity serves also as a cutting edge in the insulation cutting, piercing and displacing process in addition to the other radially and axially extending cutting edges which may be provided on the contact means.

Where only a single conductor is contained in an insulated electrical cable to which connection is to be made, a single contact means can be utilized or, alternatively, multiple contact means can be provided in a single conductor receptacle, displaced angularly and/or axially about the recess to make multiple electrical connections to the conductor. In some cases, a plurality of separate conductors are arranged within a single insulated cable, for example disposed at different angular orientations with respect to the cable axis. In this case, the electrical connector of the present invention can be used to make connection to a plurality of said conductors separately by providing a plurality of angularly displaced contact means disposed about the recess at substantially the same angular spacing as the conductors within the cable.

It will be appreciated that various combinations of high axial force by the contact means on the insulated conductor, radially and axially extending cutting edges on the contact means end portion, the outer edge of cavities formed in the end portion, and preformed knife-edged protrusions in the recess transverse to the axis of the cable, can be utilized in accordance with the invention to facilitate the making of electrical contact to the cable through the insulative sheath thereof. It has however been found, surprisingly that cutting edges are not necessary, if the end portion is formed of a domed configuration.

Thus, in another aspect, the invention provides an electrical connector for making electrical connection to an electrical conductor sheathed by an insulative covering, comprising:

a conductor receptacle having a recess therein for receiving an insulated portion of an electrical conductor; and electrical contact means supported by the receptacle and moveable transversely thereto the conductor when received in the recess, the contact means having an end portion adapted to displace or pierce an insulative covering of said portion of the insulated conductor and make electrical connection to said conductor upon such transverse movement, said end portion or said electrical contact means being of domed form substantially free of cutting edges.

The invention also provides a method for making electrical connection to an insulated electrical conductor, comprising the steps of providing an electrically conductive receptacle having a recess for receiving an insulated portion of an electrical conductor, said recess having transversely extending knife-edged protrusions formed integrally, providing a contact means which is electrically coupled to the conductor receptacle and moveable relative to the receptacle to enable an end portion thereof to protrude into said recess at a side opposite said protrusions, inserting an insulated portion of an electrical conductor in said recess, and displacing the contact means with respect to the receptacle so as to penetrate an insulative layer of the insulated conductor portion and make electrical contact with the electrical conductor underneath, and to cause said knife-edged projections to also pierce the insulative layer to make contact with the electrical conductor.

The invention still further provides a method making a conductor receptacle for an electrical connector for making electrical connection to an electrical conductor sheathed by an insulative covering, the electrical connector comprising:

said conductor receptacle having a recess therein for receiving an insulated portion of an electrical conductor; and electrical contact means supported by the receptacle and moveable transversely thereto the conductor when received in the recess, the contact means having an end portion adapted to displace or pierce an insulative covering of said portion of the insulated conductor and make electrical connection to said conductor upon such transverse movement, said recess having knife edged protrusions to facilitate the insulation piercing on a side of the electrical conductor opposite to the contact means, said method including forming said recess by use of a cutting tool having a forward portion provided with end and side cutting teeth and a following portion formed with teeth of profile complementary to the form of the protrusions, comprising advancing the tool into a block of material which is to form the conductor receptacle so that the teeth on the forward portion cut a circular recess, and then moving the tool sideways within the circular recess to sidewardly elongate the circular recess and cause the teeth on the following portion to form said protrusions as part-circular ridges.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 10 is a side view of a tool used in forming the embodiment of FIG. 6; and FIG. 11 is a fragmentary view of an alternative form of contact member useful in electrical connectors constructed in accordance with the invention.

DETAILED DESCRIPTION OF THE PREFERRED EMBODIMENT

Figure 1:
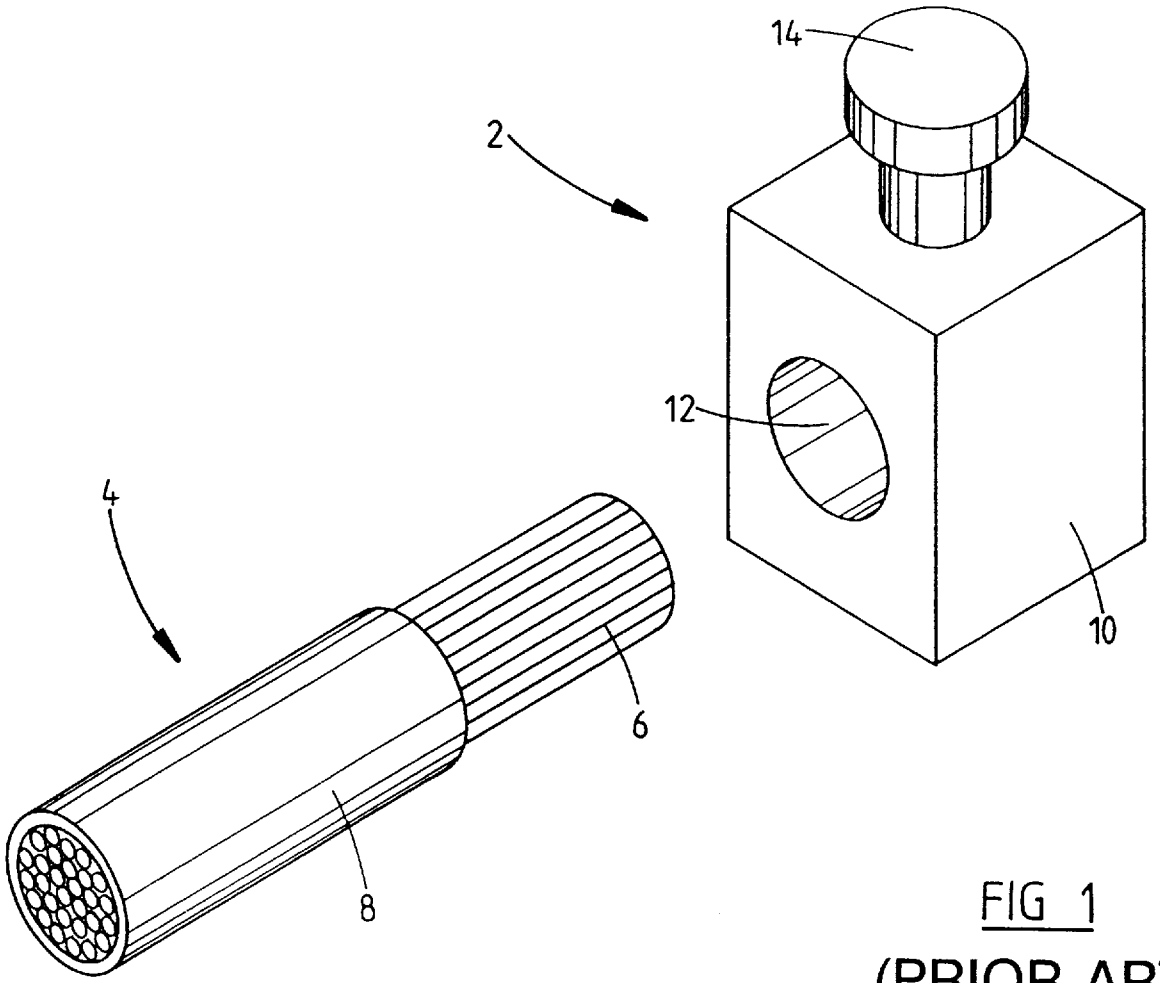
FIG 1 (PRIOR ART)
FIG. 1 illustrates a conventional means for making electrical connection to an insulated cable.
Figure 2:
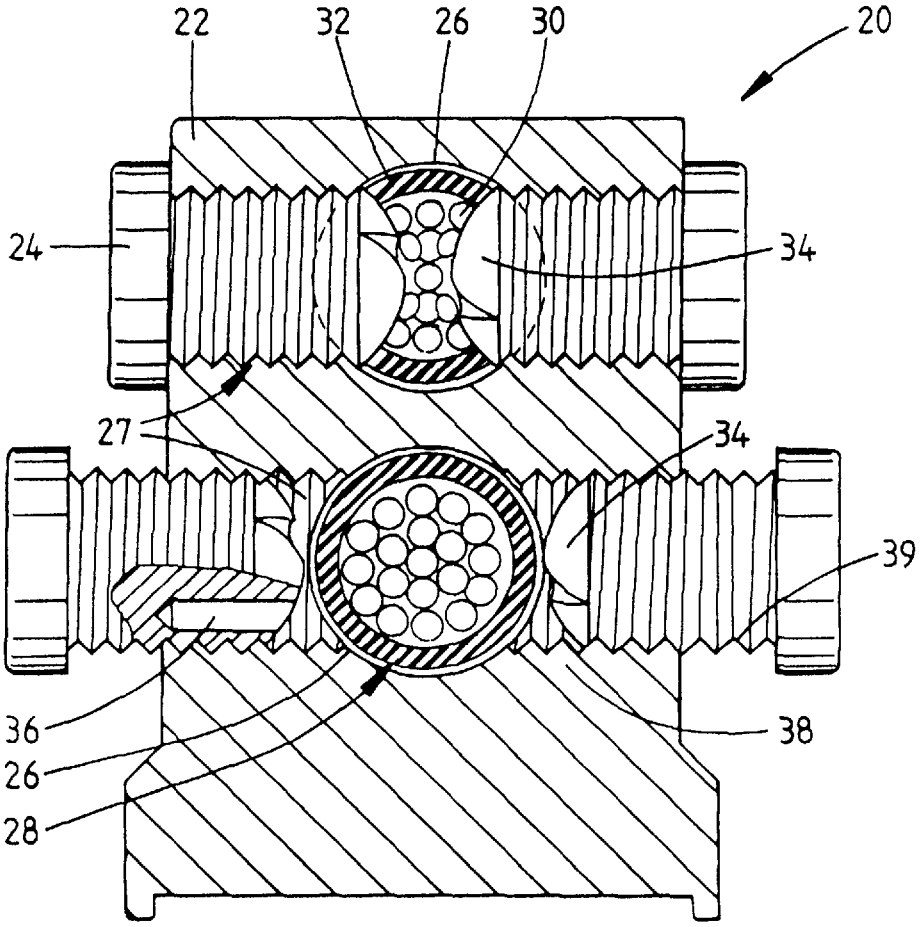
FIG. 2 is a cross-sectional view of an electrical connector in accordance with one form of the invention.

The embodiments of the present invention which are described in detail hereinbelow and in the drawings, provide the advantage that removal of the insulative layer from an insulated electrical cable is not necessary in order to make electrical connection to the conductor or conductors within the cable. Additionally, an advantage in physical connections can be achieved between the cable and connector by physically engaging both the conductor core itself as well as the insulative sheath of the cable. Referring now to FIG. 2, there is shown a cross-sectional view of an electrical connector 20 constructed in accordance with one form of the invention. The connector shown in FIG. 2 is adapted to make connection to two insulated electrical cables. The electrical connector 20 comprises a conductor receptacle or body in the form of a connector block 22 having two cylindrical cable recesses 26 therein, shown in cross-section, for receiving electrical cables. A plurality of contact passages 27 are also provided in the connector block 22, extending between the exterior of the block 22 and respective cable recesses 26. The direction of extent of the passages 27 are transverse and generally orthogonal to that of the recesses 26. The passages 27 are formed with an internal screw thread 38. The internal screw thread 38 of the passages 27 allows a contact member 24, in the form of a bolt-like member with a complimentary external screw thread 39, to be received in a passage 27 with threaded engagement with the connector block 22. Each contact member 24 is constructed with an end portion 34 with, in this instance, a rounded profile. By screwing the contact member 24 into the passage 27, the end portion 34 thereof can be made to protrude into the corresponding recess 26. Each recess 26 is dimensioned in cross-section to receive an insulated electrical cable 28 which comprises a conductor core formed from strands 30, sheathed by an outer insulative layer 32. To make electrical connection to such a cable, a section of the cable is inserted in a recess 26 to an extent where a portion of the cable lies adjacent the intersection of the recess 26 and a passage 27. A contact member 24 inserted in the passage 27 is advanced toward the recess 26 by a screwing action, until the end portion 34 of the contact member abuts the outer surface of the insulative layer 32 of the cable. The contact member 24 is then advanced further toward the axis of the cable 28 held in passage 26, such that the end portion 34 of the contact member presses into the insulating sheath and eventually penetrates the insulative layer to make contact with the conductor strands 30 at the core of the cable 28, thus establishing an electrical connection between the conductor strands 30 and the end portion 34 of the contact member 24. The penetration of the insulating sheath by the contact member involves some deformation of the cable portion, and may also involve deformation of the connector block 22 to a small extent. This deformation is at least partially elastic in nature, which aides in clamping the cable portion within the recess 26 of the electrical connector. Furthermore, since the end portion 34 of the contact member is held in a position where it pierces the insulating sheath 32, the sheath itself is also anchored to the electrical connector 20 as well as the conductors themselves.

Figure 3:
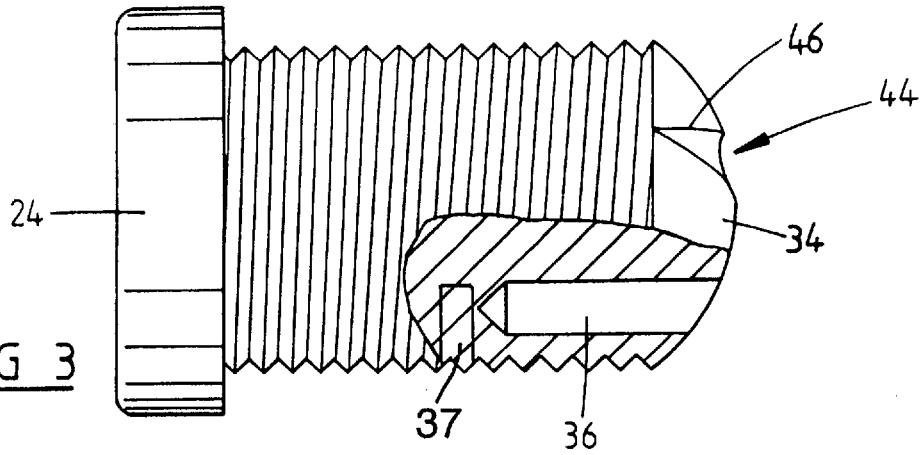
FIG. 3 is a close-up view of an end portion of an electrical contact means for the invention.

The cable shown in the upper recess 26 in FIG. 2 is in electrical contact with two contact members 24, which can be seen penetrating the insulative sheath 32 from the left and right sides in the drawing. The conductor strands 30 of the cable are compressed by the contact members in the recess and make electrical contact with the surface of the end portions 34 of the contact members. The cable in the lower recess in FIG. 2 is shown before an electrical connection is made thereto, where the respective contact members 24 have not yet been advanced in passages 27 to protrude into the recess 26. Once an electrical connection between the contact member 24 and conductors 30 of the cable 28 has been established, an external electrical connection can be made to the contact member 24. One way in which the external connection can be achieved is to construct the internal screw thread structure 38 of the passage 27 from a conductive material, whereby an electrical connection is established between the contact member 24 and the conductive thread structure 38 by contact between the complimentary internal and external threads 38,39. This conductive thread structure may in turn be connected to, for example, a circuit breaker terminal or the like, which may be incorporated into the same structure as the connector block 22. In order to aid the end portion 34 of the contact member in piercing the insulation sheath of an electrical cable, the end portion can be provided with one or more cutting edges or profiles. An end portion 34 of a contact member 24 is illustrated in close-up in FIG. 3, which shows where the rounded end portion has a spiral section 44 removed so as to form a cutting edge 46 (knife edged protrusion means). It is envisaged that many different types of cutting edges formed on the end portion 34 would be suitable in aiding in the penetration of the contact member 24 through the insulation layer 32.

Referring again to FIG. 2, the contact member 24 shown in the lower left hand quadrant of the electrical connector is provided with an axially extending cavity 36 which opens to the end surface of end portion 34. This is shown in greater detail on the contact member in FIG. 3. In practice, it has been found advantageous to provide abutting surfaces which make electrical contact with a cable jointing compound, which facilitates the cleaning of the electrical contact area, repels moisture and inhibits corrosion build up to maintain a good electrical contact between the abutting surfaces. Thus, a cavity 36 can be provided in the contact member 24, which is open to the end portion 34 and filled with a jointing compound before use. Cavity 36 is preferably asymmetric with and spaced from a longitudinal center axis of contact member 24. Additional cavities 37 filled with jointing compound can also be provided opening to the internal screw thread surface 38 to facilitate better electrical connection between the screw thread surfaces of the connector block 22 and contact member 24. The edge of the cavity 36 on the surface 34, serves also as a cutting edge in displacing and piercing the insulation sheath 32. This cavity edge enables a considerable reduction in the piercing force required of the contact member on the cable exterior.

Figure 4:
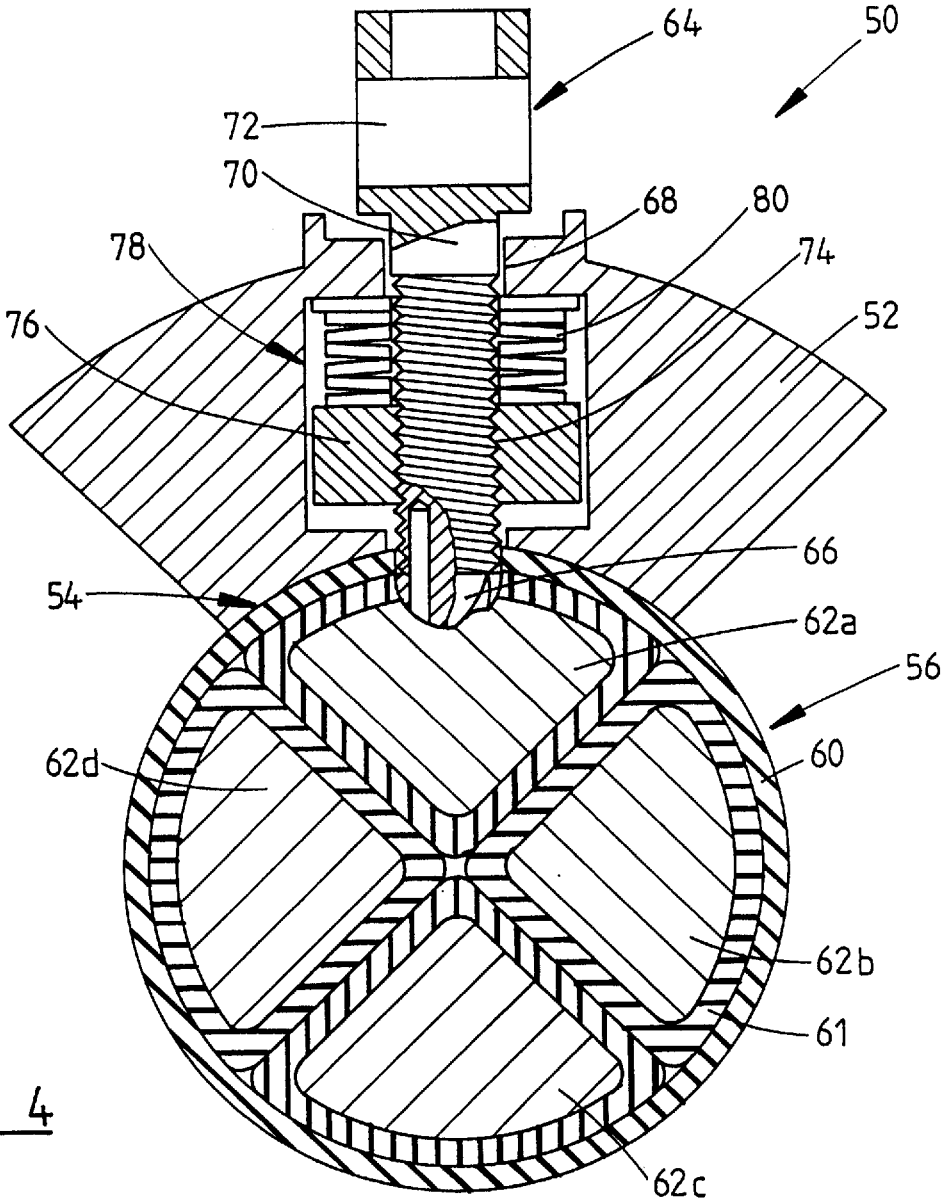
FIG. 4 is a part cross-sectional view of an electrical connector in accordance with another form of the invention.

As can be seen from the electrical connector arrangement in FIG. 2, where two passages 27 are provided for each recess 26, multiple contact members 24 can be utilized to make electrical connection to the same conductors 30 of a single conductor cable 28. FIG. 4 shows an alternative electrical connector arrangement 50, wherein a portion of a connector block 52 and multi-conductor cable 56 are shown in cross-section. In some electrical current carrying cables, a plurality of separate conductors are provided within the same insulative sheath. For example, an electrical cable adapted to carry three phase power may have four separate conductors within the same cable, one for each phase and one neutral conductor. In this case, the separate conductors may be arranged within the insulative sheath angularly displaced from one another about the cable axis. FIG. 4 illustrates a cable 56 of this type, comprising a plurality of conductors 62*a*, 62*b*, 62*c* and 62*d* disposed within an insulating sheath 60. As mentioned, only a portion of the electrical connector 50 is shown, which might ordinarily extend completely around the circumference of the cable 56, in the manner of the connector 20 shown in FIG. 2. The portion 52 of the connector is shown with the cable 56 located in the recess 54 of the electrical connector, such that a conductor 62*a* of the cable is aligned with a passage 68 formed through the connector block 52. The opening of the passage 68 to the recess 54 is broadened at 78 to accommodate a spring biasing means comprising a block 76 having an internally screw threaded hole therethrough and a spring device 80. The spring device 80 is positioned between a flanged surface of the widened passage 78 and the block 76, and acts to press the block 76 toward the surface of cable 56 when positioned in the recess 54. A contact member 64 has an external head portion 72 to enable rotation of the contact member, a shaft 70 which passes through the passage 68 formed in the connector body 52, a threaded shaft portion 74 which engages the threaded hole formed in block 76, and an end portion 66 which can be made to protrude into the recess 54, as described hereinabove. The operation of the electrical connector 50 illustrated in FIG. 4 is generally the same as the electrical connector 20 shown in FIG. 2, except that a spring bias is provided to the contact member 64 by the spring device 80 acting on the block 76 to which the contact member 64 is threadedly engaged. This spring bias acts to press the end portion 66 of the contact member toward the conductor 62 so as to ensure the maintenance of a reliable, stable and good electrical connection therewith.

Furthermore, although FIG. 4 illustrates only connection to a single conductor 62 of the plurality of conductors in cable 56, it is possible to provide the electrical connector 50 with a plurality of contact members 64 angularly displaced from one another at angles corresponding to the locations of the respective conductors in the cable. In this way, it is possible to provide an electrical connector 50 which can make connection to each of the conductors in a multi conductor cable, or any one or more of the conductors as desired. It must be borne in mind that the conductors in a multiconductor cable may have additional insulative layers, such as individual insulation layers 61, which the contact member 64 must pierce in order to make electrical connection with one of the conductors.

Figure 5:
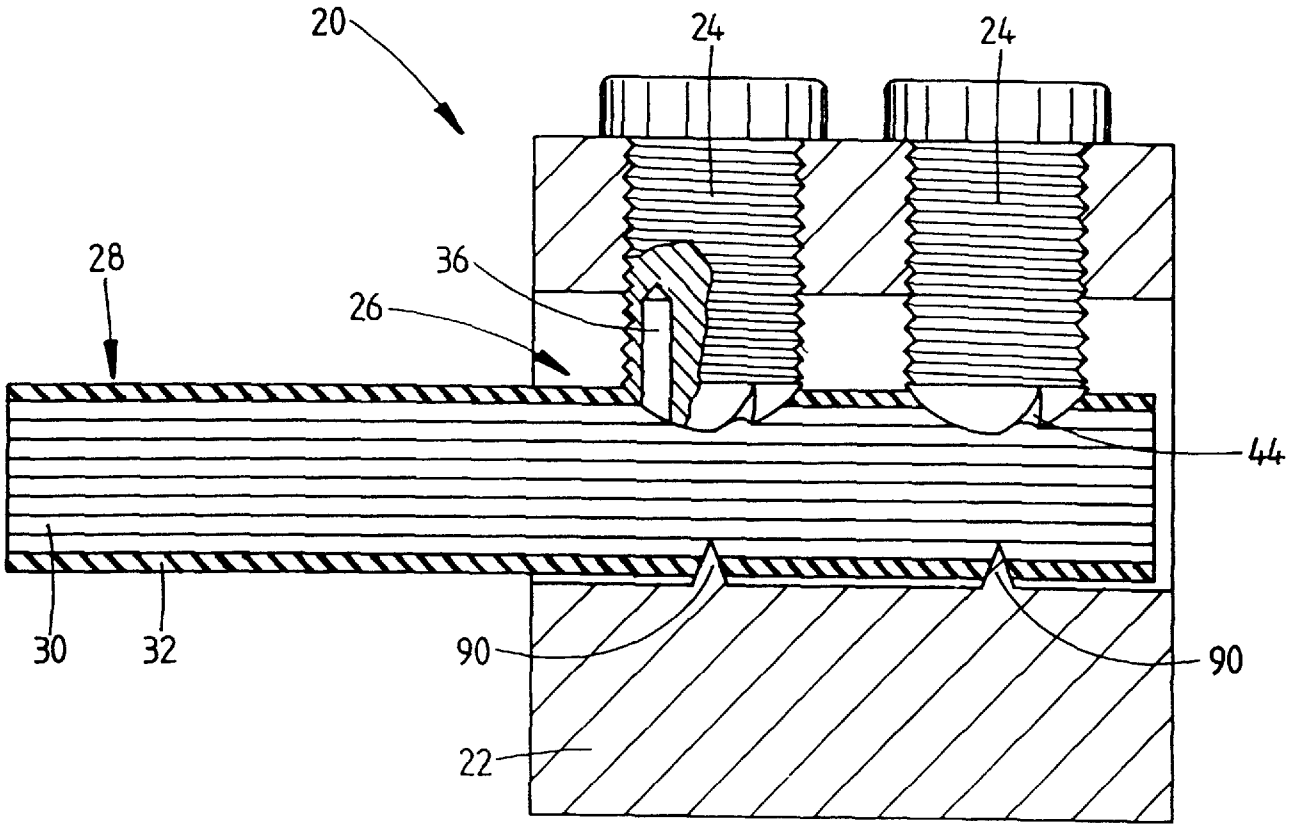
FIG. 5 is a cross-sectional view of an electrical connector in accordance with another form of an invention.

FIG. 5 shows an alternative electrical connector 20 in longitudinal cross-sectional view. Like the connector shown in FIG. 2, the connector block 22 has a recess 26 formed therein, into which contact members 24 can be made to protrude. In this instance, however, the recess 26 is made larger in the cross-sectional dimension in which the contact members are moveable, and the recess surface opposite the contact members is provided with knife edged protrusions 90. The recess 26 is enlarged to allow the cable 28 to be inserted therein over the protrusions 90. When the contact members 24 are extended into the recess, the force of the contact members bearing on the cable causes the insulation 32 to be pierced by the protrusions 90 as well as by the contact members themselves. The knife edged protrusions thus provide both increased electrical contact area with the conductors 30 of the cable, and also increased mechanical anchoring stability of the cable 28 within the connector 20.

Figure 7:
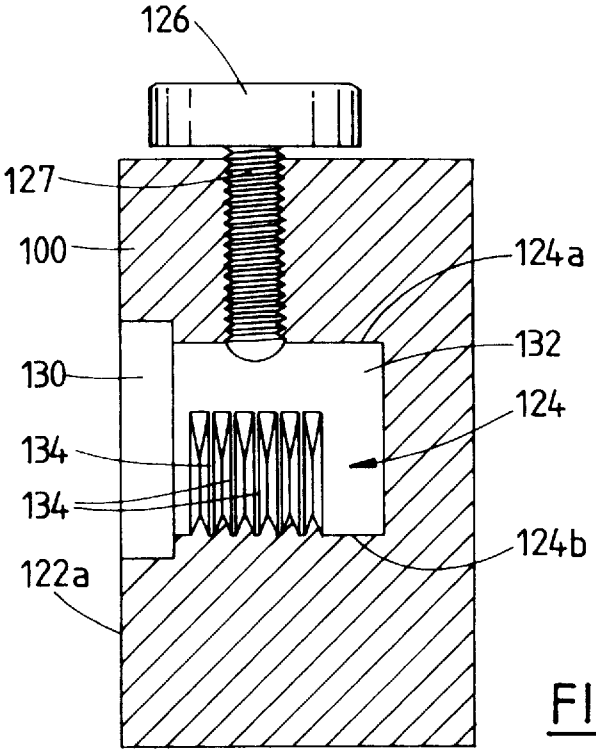
FIG. 7 is a cross-sectional view of the embodiment of FIG. 6 taken on line x—x in FIG. 6.
Figure 6:
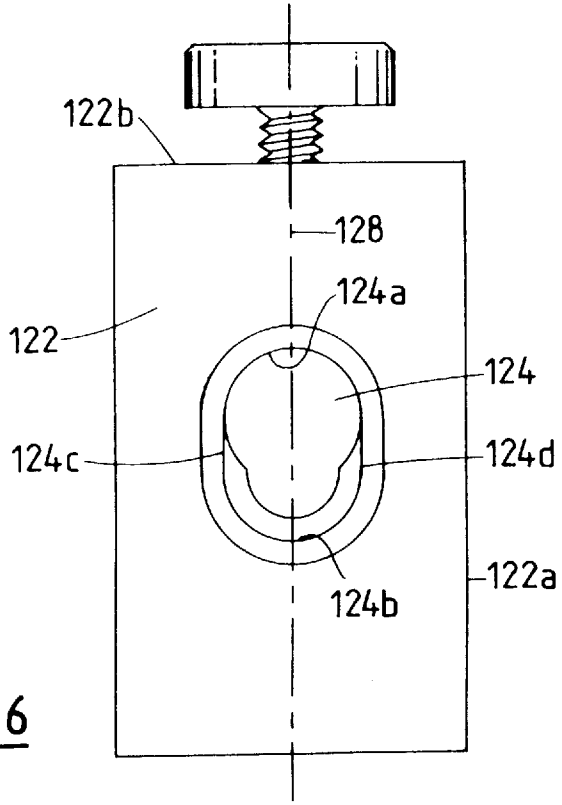
FIG. 6 is a front view of another embodiment of the invention.

The electrical connector 100 shown in FIGS. 6 and 7 functions in a similar fashion to those previously described. Connector 100 comprises an electrically conductive receptacle 122 in the form of a connector block having a somewhat cylindrical recess 124 therein and extending inwardly from a front face 122*a* of the receptacle 122. In cross-section, the recess has two opposed semi-circular portions 124*a*, 124*b* interconnected by straight line portions 124*c*, 124*d* (FIG. 6). This configuration results from the method of formation of the recess which is described later.

A screw threaded passage 127 is provided in the receptacle 122, extending inwardly from a side face 122*b* of the receptacle 122. An electrically conductive contact member 126 similar to the contact members previously described is screw threaded into the passage 127 so as to be capable of being advanced or retracted therein by rotation thereof. The axis of the passage 127 is normal to the lengthwise direction of extent of the recess 124, and aligned in a plane 128 (FIG. 6) about which the cross-section of the recess is symmetrical. The passage 127 breaks into the recess 124 at a location centrally disposed with respect to the semi-circular portion 124*a* of the cross-section of the passage, also as shown in FIG. 6. The contact member 126 is formed of electrically conductive material and is thus coupled electrically to the receptacle 122.

The recess 124 has, as shown in FIG. 7, an outer section 130 which is rather shallow and of somewhat increased cross-section as compared with an inner section 132 of the recess. The passage 127 breaks into the recess at section 132, approximately midway along the length thereof At the semi-circular portion 124*b* of the recess 124, at section 132 of the recess, there is provided, on the inner surface of the recess and opposite the passage 127, a number of integrally formed knife-edged projections 134 which are, in this case, substantially parallel and closely positioned next to each other, being spaced apart in the lengthwise direction of extent of the recess 124. The projections 134 are of substantially semi-circular form when viewed in the direction of extent of the recess 124, and extend transversely (for example at 90') to the direction of extent of the recess 124.

It has been found that the protrusions 134 (or the projections 90 in the arrangement of FIG. 5), substantially enhance the performance of the connector 100. This arises particularly where, as is usual, the cable to be connected is in the form of a number of generally axially extending strands. In cases where the interior surface of the recess is plain without projections or the like, there is a tendency for contact pressure with the connector receptacle to become reduced over time due to elastic deformation effects. This is particularly the case where there is insulation or other resilient or structurally weak materials included in the cable which may result in a situation where, at first, a strong clamping action was achieved, but where, under continued pressure from the clamping, these materials eventually partially collapse or become compressed in such a fashion as to permit the clamping force to be reduced, possibly to an unacceptable level. On the other hand, the provision of the knife-edged protrusions 134 described causes the tips of the protrusions, which extend transversely to the cable, to pierce the insulation of the cable and be brought into particularly firm engagement with the cable strands during the clamping action, and it has been found that tendency for relief of clamping forces over time is considerably reduced. Because the protrusions 134 are integral with the receptacle 122, there is no tendency towards movement of the protrusions with respect to the receptacle, so that firm gripping is achieved. At the same time, the good electrical interconnection, as between protrusions 134 and contact member 126 and the cable, provided also via the receptacle 122, ensure good electrical connection to the cable.

The recess 124 is as shown in FIG. 7 largely circular in cross-section save for the downwardly elongated part opposite to the location of the passage 127, at which the protrusions 134 are located. FIG. 10 shows a tool 140 suitable for forming the recess 124 in this shape.

Figure 8:
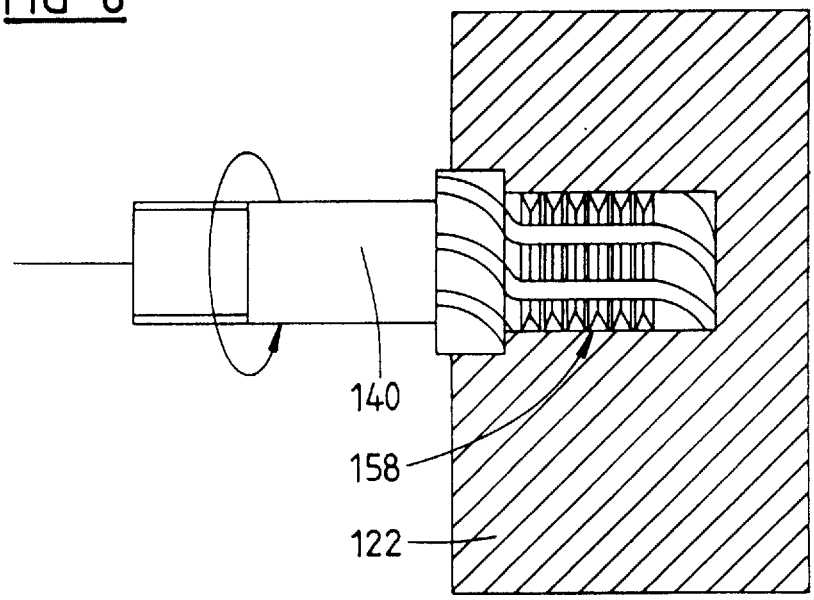
FIGS. 8 and 9 are cross-sectional views illustrating steps in manufacture of the embodiment of FIG. 6.
Figure 9:
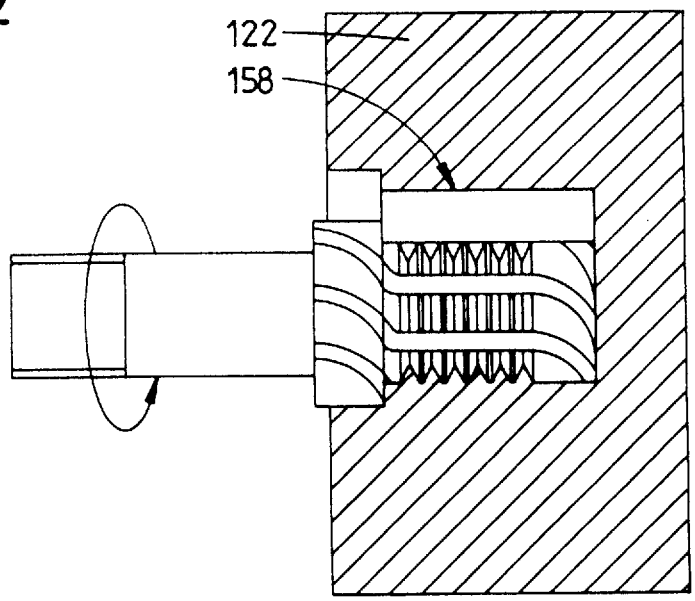

Tool 140 is in the form of an elongate member having a shank 142 and a cutting portion 144 extending therefrom. The cutting portion 144 includes a first shallow cylindrical portion 146 having cutting teeth both on the side edge thereof and at a forward face 147. An intermediate portion 148 of cutting portion 144 extends from portion 146 and has a series of peripheral ridges 150 spaced along the axis thereof these ridges having a profile complementary to the profile of the protrusions 134. Cutting edges 153 are formed on portion 146, by interrupting the ridges 150, by lengthwise extending channels 151 over the portion 148. Finally, the portion 144 has a tip portion 152 of shallow cylindrical form and having channels 156 formed therein to define cutting teeth 154 on the side face and forward end face 155. Portion 152 has a diameter equal to the maximum diameter of the portion 148, being somewhat less than the diameter of the portion 146. FIGS. 8 and 9 show the use of the tool 140 to form the recess 124. In a first step (FIG. 8) the tool 140 is advanced axially, while being rotated, to cause portion 144 thereof to cut into the receptacle 122 and form a circular cross-sectioned recess 158. The cutting teeth on the forward end face 155 act in conjunction with the teeth on the side of the tip portion 152 to effect this cutting. The so-formed recess 158 has an inner portion which is formed in this fashion and an outer portion which is formed by the teeth on the side and forward surfaces of the portion 146. The depth of the outer portion is equal to the depth of the recess section 130 of the final recess 124 and the depth of the inner portion corresponds to the depth of the recess section 132 of the final recess 124. Following the step in FIG. 9, while continuing to rotate the tool 140, the tool is moved sideways (downwardly as viewed in FIG. 9). Under this action, the portion 144 continues to cut material from the receptacle 122, both along the inner end of the recess 158 and at the side thereof. At this time too, the cutting teeth 153 formed on the portion 148 cut into the side surface of the recess 158 to form the protrusions 134. Similarly, the sideways movement of the portion 146 serves to cut into the side of the recess 158 at the location of the larger diameter portion of the recess 158. By this fashion, the recess 158 is sideways elongated in cross-section to produce the final recess 124, with the protrusions 134 formed and positioned as shown. Subsequent to the formation of the recess 124, the passage 127 is formed and screw threaded to accommodate the contact member 126.

The connector 100 may be used in the same fashion as those previously described and, in particular, the contact member may be formed with an inner end portion as previously described, formed with cutting edges and profiled as described. It has been found however that it is possible to simply form the inner end of the contact members useful in the invention in the configuration shown in FIG. 11, where the end portion 160 of the connector member is formed as a domed formation which is smooth, being free of cutting edges. The formation may for example be semi-spherical, and may include one or more cavities like the cavity 36 previously described, and filled with jointing compound.

While specific embodiments of the invention have been shown and described in detail to illustrate the application of the principles of the invention, it will be understood that the invention may be embodied otherwise without departing from such principles.

What is claimed is:

1. An electrical connector for making an electrical connection to an electrical conductor sheathed by an insulative covering, the connector comprising:

a body defining a recess for receiving an insulated portion of the electrical conductor; and electrical contact means movably connected to said body in a direction substantially perpendicular to a longitudinal axis of the conductor when said conductor is positioned in said recess, said contact means having an end portion adapted to displace the insulative covering of said portion of the insulated conductor and make an electrical connection with said conductor upon movement of said electrical contact means into contact with the insulative covering, said end portion defining a cavity with an opening asymmetrically positioned with respect to a longitudinal center axis of said contact means, said body having knife edged protrusion means extending into said recess for insulation displacement and electrical connection on a side of the electrical conductor substantially opposite to said contact means, said body being electrically conductive with said knife edged protrusions means, said electrical contact means being electrically connected to said conductive body.

2. An electrical connector as claimed in claim 1, wherein:

said contact means has means for movement relative to said body;

one of said contact means and said body includes means for biasing said contact means against said conductor.

3. An electrical connector according to claim 1, wherein:

said end portion of said contact means includes an insulation cutting surface for displacing the insulative covering, said cutting surface including edges of said opening of said cavity.

4. An electrical connector according to claim 1, wherein:

said contact means is formed as a screw threaded bolt having a substantially rounded end with a radially and axially extending cutting edge.

5. An electrical connector according to claim 1, wherein:

a jointing compound is provided on said end portion of said contact means.

6. An electrical connector according to claims 1, wherein:

another cavity filled with jointing compound is positioned where said contact means engages said body to increase electrical contact.

7. An electrical connector according to claim 1, wherein:

a plurality of angularly displaced contact means are positioned about said recess.

8. An electrical connector as claimed in claim 1, wherein:

said knife edge protrusions are formed integrally with said body.

9. An electrical connector as claimed in claim 1, wherein:

said knife edge protrusions are formed by another electrical contact means movably connected to said body and movable into said recess.

10. An electrical connector as claimed in claim 1, wherein:

said body defines a contact passage with internal threads;

said contact means includes an external screw thread for engaging said internal threads of said contact passage, wherein rotation of the contact means about said longitudinal center axis causes relative movement between said contact means and said body to cause said contact means end portion to protrude into said recess and make electrical connection with the insulated conductor positioned in said recess.

11. An electrical connector as claimed in claim 10, wherein:

said body includes a spring loaded block biased towards said recess;

said contact means engages said spring loaded block to bias said contact means against said conductor subsequent to insulation displacement.

12. An electrical connector according to claim 1, wherein:

said cavity is filled with jointing compound.

13. An electrical connector according to claim 12, wherein:

an outer edge of said cavity serves as a cutting edge.

14. An electrical connector as claimed in claim 1, wherein:

said knife edged protrusion means are concavely part-circular when viewed in a lengthwise direction of extent of said recess.

15. An electrical connector as claimed in claim 14, wherein:

said recess has a cross-sectional form of two opposed semi-circular portions interconnected by straight line portions, and with said knife-edged protrusion means being disposed at one of said semi-circular portions;

said electrical contact means being arranged at another of said semi-circular portions.

16. An electrical connector as claimed in claim 14, wherein:

said knife-edged protrusion means are substantially semi-circular when viewed in the lengthwise direction of extent of said recess.

17. An electrical connector as claimed in claim 16, wherein:

said recess has a cross-sectional form of two opposed semi-circular portions interconnected by straight line portions, and with said knife-edged protrusion means being disposed at one of said semi-circular portions;

said electrical contact means being arranged at another of said semi-circular portions.

* * * * *